US008205871B2

(12) United States Patent
Farlotti

(10) Patent No.: US 8,205,871 B2
(45) Date of Patent: Jun. 26, 2012

(54) SEPARATOR DEVICE USING BALLS FOR SEPARATING FLAT ARTICLES

(75) Inventor: Laurent Farlotti, Pruniers (FR)

(73) Assignee: Neopost Technologies, Bagneux (FR)

( * ) Notice: Subject to any disclaimer, the term of this patent is extended or adjusted under 35 U.S.C. 154(b) by 345 days.

(21) Appl. No.: 12/690,666

(22) Filed: Jan. 20, 2010

(65) Prior Publication Data

US 2010/0183421 A1 Jul. 22, 2010

(30) Foreign Application Priority Data

Jan. 22, 2009 (FR) ..... 09 50377

(51) Int. Cl.
*B65H 3/04* (2006.01)

(52) U.S. Cl. ..... 271/35; 271/23; 271/104; 271/121; 271/131; 271/137

(58) Field of Classification Search ..... 271/23, 271/35, 104, 121, 131, 137
See application file for complete search history.

(56) References Cited

U.S. PATENT DOCUMENTS

| | | | | |
|---|---|---|---|---|
| 2,701,662 | A * | 2/1955 | Smith | 271/135 |
| 4,085,848 | A * | 4/1978 | Tsuge | 248/316.3 |
| 5,342,040 | A * | 8/1994 | Markgraf | 271/184 |
| 2004/0032076 | A1 * | 2/2004 | Kawakami | 271/121 |
| 2005/0098940 | A1 | 5/2005 | Malatesta | |
| 2005/0242487 | A1 | 11/2005 | Pelletier et al. | |

FOREIGN PATENT DOCUMENTS

| | | | |
|---|---|---|---|
| EP | 0 856 483 | A1 | 8/1998 |
| JP | 03284560 | A * | 12/1991 |
| JP | 04-45030 | A | 2/1992 |

* cited by examiner

*Primary Examiner* — Gerald McClain
(74) *Attorney, Agent, or Firm* — Sughrue Mion, PLLC

(57) ABSTRACT

A separator device for separating flat articles one-by-one from a stack of flat articles and for conveying them downstream, said separator device comprising at least one flexible bag provided with a plurality of balls and co-operating with a drive member so that, by deforming while said flat articles are being conveyed downstream, it separates said flat articles one-by-one. A particular application lies in separating mail-pieces.

10 Claims, 3 Drawing Sheets

SEPARATOR DEVICE USING BALLS FOR SEPARATING FLAT ARTICLES

TECHNICAL FIELD

The present invention relates to the field of mail handling, and it relates more particularly to a separator device for separating flat articles, such as mailpieces, which device is implemented in a postage meter or "franking machine" for franking mailpieces.

PRIOR ART

In franking machines, the mailpieces are generally presented in stacks of mailpieces of different formats and weights, and of various thickness, that need to be separated one-by-one in order to enable a postal imprint to be put on each of them. That process of separating the mailpieces is very important in order to avoid bunching, i.e. two mailpieces going through together as one. Such bunching is highly prejudicial because it gives rise both to one of the two bunched-together mailpieces being over-invoiced (two mailpieces being weighed instead of a single mailpiece) and to the bottom mailpiece not being franked.

Also, in present-day franking machines, such separator devices are relatively complex with mechanisms having guides and springs that are particularly difficult to adjust, in particular when the mailpieces are to be processed at high throughput rates, typically greater than 12,000 envelopes per hour. It is necessary to adjust the disposition, the angle of inclination, and the pressure of the guide, regardless of the types of envelope used, and of the formats, of the thicknesses, and of the weights of said envelopes. For mailpieces of low thickness, the force exerted on the guide must be large in order to limit the number of times two envelopes are bunched together, whereas it must be small for mailpieces of higher thickness. Unfortunately, since the guide is pressed against the mailpiece by a compression spring so as to avoid such bunching, mailpieces that are of high thickness, and in particular those that have windows, might be damaged or torn.

OBJECT AND DEFINITION OF THE INVENTION

An object of the present invention is to mitigate the above-mentioned drawbacks by proposing a separator device for separating flat articles, such as mailpieces, one-by-one from a stack of flat articles and for conveying them downstream, wherein said separator device comprises at least one flexible bag provided with balls and co-operating with a drive member so that, by deforming while said flat articles are being conveyed downstream, it separates said flat articles one-by-one.

By means of this simplified structure, a pressing force is obtained that adapts continuously to accommodate the thicknesses of the various flat articles. When said articles are envelopes, the quality of separation of the envelopes is thus greatly improved regardless of whether said envelopes are thin or thick.

Advantageously, said flexible bag is in the shape of a block of trapezium-shaped section, and it may have a plurality of compartments. Said flexible bag may be made of a technical textile material such as nylon.

Preferably, said balls have a diameter of less than 10 millimeters (mm), and are made of a material chosen from the following materials: metal; glass, and elastomer.

Depending on the embodiment, said drive member comprises at least one series of motor-driven rollers, or at least one motor-driven belt.

The present invention also provides a mailpiece feeder for a franking machine, which feeder includes a mailpiece separator device as defined above.

BRIEF DESCRIPTION OF THE DRAWINGS

Other characteristics and advantages of the present invention appear more clearly from the following description, given by way of non-limiting indication, and with reference to the accompanying drawings, in which.

DETAILED DESCRIPTION OF A PREFERRED EMBODIMENT OF THE INVENTION

Figure 1:
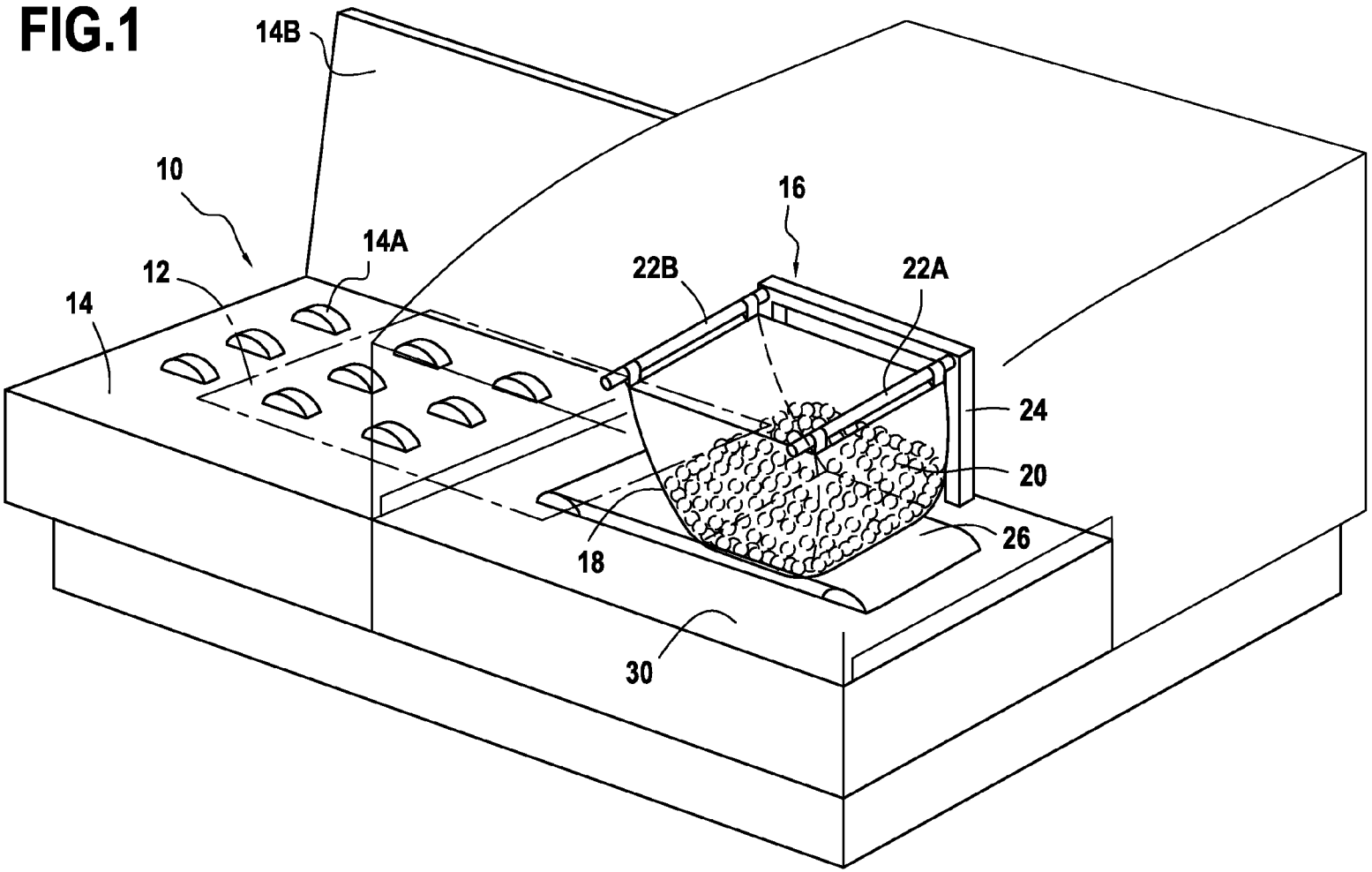
FIG. 1 is a perspective view of a feeder incorporating a mailpiece separator device of the invention.

An automatic feed module 10 for automatically feeding mailpieces 12, such as the automatic feed module shown in FIG. 1, conventionally includes a feed zone formed essentially of a deck 14 that is designed to receive a stack of mailpieces of different sizes and thicknesses, and that is provided with first conveyor rollers 14A for driving said mailpieces downstream (and against a referencing wall 14B) to a separation zone that is provided with a separator device 16 in which said mailpieces are extracted one-by-one from the stack of mailpieces. Second conveyor rollers (not shown) are, in general provided at the outlet of said separation zone for the purpose of conveying the mailpieces extracted in this way downstream one-by-one. Such an automatic feeder is, for example, disclosed in European Patent EP 0 856 483 filed in the name of the Applicant.

In the invention, the separator device for separating mailpieces essentially comprises at least one flexible bag 18 provided with a plurality of balls 20 and co-operating with a drive member to act, by deforming while mailpieces are being conveyed downstream, to separate the mailpieces one-by-one. The flexible bag that is in the shape of a block of trapezium-shaped section is held in position, at the horizontal plane forming the large base of the trapezium by two hanger arms 22A, 22B that extend transversely from a gantry-shaped frame 24. It should be noted that this trapezium-shaped section makes it possible to reproduce the inclined shape of a conventional selector guide.

In FIG. 1, the drive member is constituted merely by a motor-driven belt 26 that occupies almost the entire area of the surface for receiving the mailpieces. The bottom portion of the flexible bag 18 (corresponding to the horizontal plane forming the small base of the trapezium) is in direct contact with the motor-driven belt. The balls are entirely free to move inside said flexible bag, and their mobility makes it possible to achieve a kind of continuous adaptation as a function of the thicknesses of the mailpieces. For this purpose, the balls advantageously have a diameter of less than 10 mm and they are made of a metal, glass, or elastomer material that is of sufficient density to enable the mailpieces to be separated. Naturally, the material of which the flexible bag is made must have a coefficient of friction relative to mailpieces that is less than the coefficient of friction between said mailpieces and the belt 26, so as not to prevent the mailpieces being driven. For example, the bag may be made of a technical textile material such as nylon.

Figure 2:
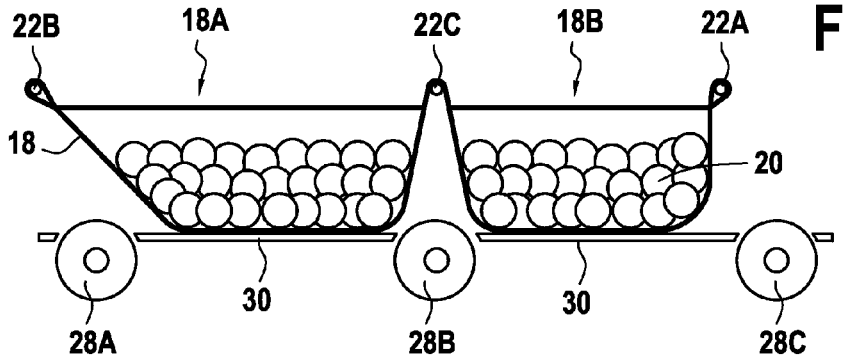
FIG. 2 shows a second embodiment of the mailpiece separator device that can be incorporated into the feeder of FIG. 1.

In FIG. 2, the conveyor member is constituted by three parallel series 28A, 28B, 28C of three motor-driven rollers, and the flexible bag 18 is compartmented so that its bottom portion is not in direct contact with the motor-driven rollers and thus not subjected to continuous friction. More particularly, the flexible bag has two compartments 18A, 18B that are held by three hanger arms 22A, 22B, 22C and that have their bottom portions resting on the surface 30 that receives the mailpieces, one of said bottom portions resting on said surface between the first and second rollers of the three series of rollers and the other of said bottom portions resting on said surface between the second and third rollers of said three series of rollers. As in the preceding configuration, the first compartment that is in direct contact with the stack of mailpieces is in the shape of a block of trapezium-shaped section whereas the second compartment may be merely of rectangular section.

Figure 3A:
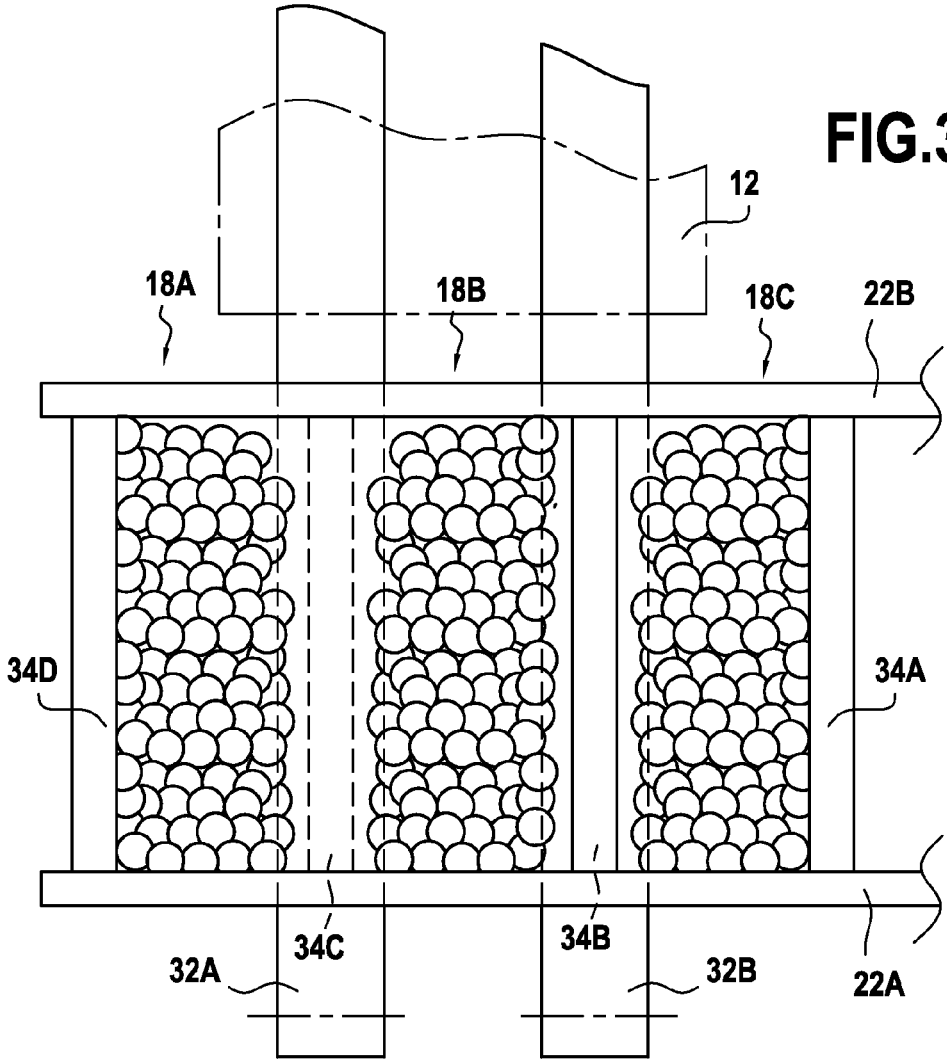
FIGS. 3A and 3B are a plan view and an end view of a third embodiment of the separator device that can be incorporated into the feeder of FIG. 1.
Figure 3B:
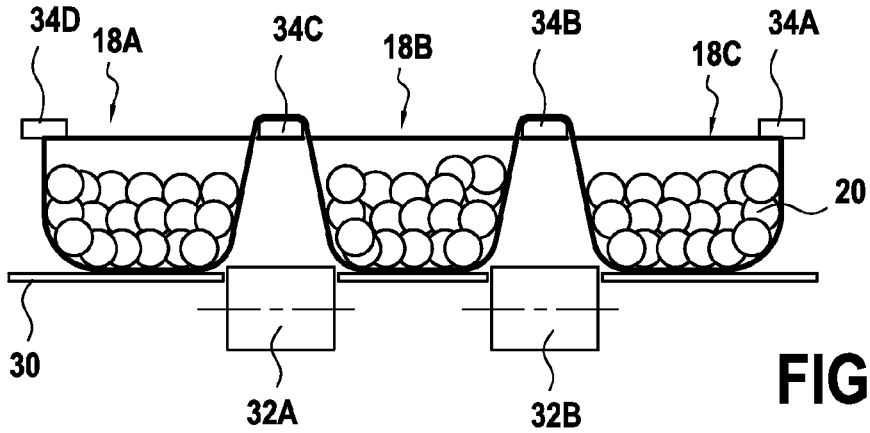

FIGS. 3A and 3B show another example of compartmenting of the flexible bag with a drive member comprising two parallel motor-driven belts 32A, 32B. In this configuration, the flexible bag has three compartments 18A, 18B, 18C held by four separator bars 34A, 34B, 34C, 34D disposed between the two hanger arms 22A, 22B and whose bottom portions rest on the surface for receiving the mailpieces between and on either side of the motor-driven belts. Said compartments are independent from one another so as to not to affect the separating capacity of each compartment and so that the balls cannot go from one compartment to another. In addition, since the flexible bag is not in contact with the drive belts, wear due to continuous friction is limited.

Operation of the separator device of the invention is described below with reference to the simplified diagrams of FIGS. 4A and 4B. Unlike many prior art separator devices, it is not necessary to perform prior sorting of the mailpieces as a function of their thicknesses, by placing the mailpieces of low or standard thickness on top, because, with the separator device of the invention, the pressure on the mailpieces is not preset by predetermined adjustment but rather it depends on the weight of the balls and is independent of the deformation of the flexible bag.

Figure 4A:
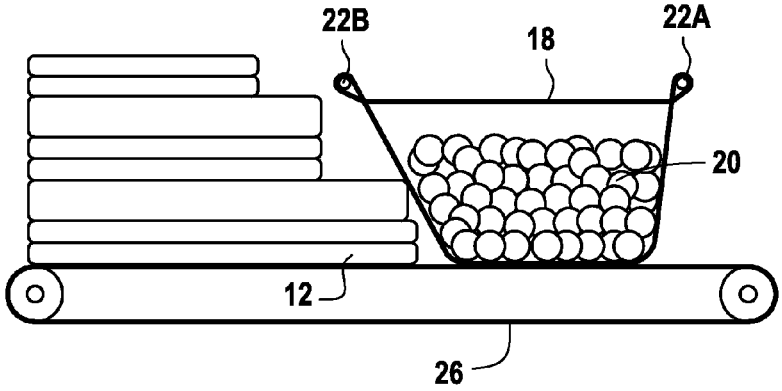
FIGS. 4A and 4B are diagrammatic section views for explaining how the separator device of the invention operates.
Figure 4B:
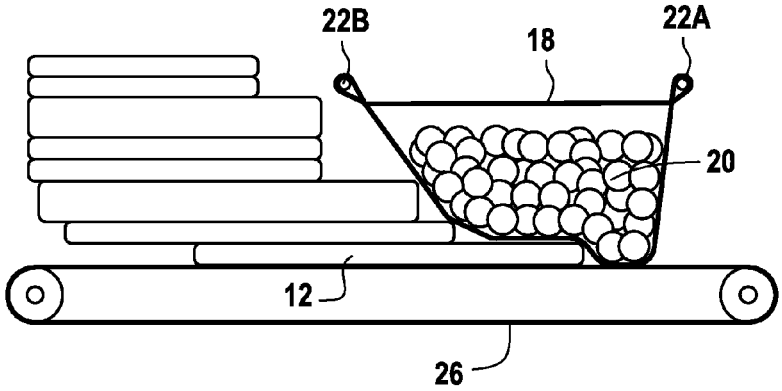

FIG. 4A shows the separator device in its rest position before any separation takes place. The mailpieces 12 of different formats and thickness are disposed on the motor-driven belt 26 and the flexible bag 22 rests thereon. It is possible to observe its trapezium-shaped section with the small base of the trapezium resting on the belt 26 and the large base of said trapezium held parallel by the hanger arms 22A, 22B. In FIG. 4B, separation has begun, and the mailpieces have advanced under the effect of the drive from the motor-driven belt 26, the bottom mailpiece having advanced fastest due to the difference that exists between the coefficient of friction of the belt and the coefficient of friction of the mailpieces. On moving, the bottom mailpiece has deformed the flexible bag and has slid underneath it, pushing the balls away and thereby making it easier for it to be separated from the next mailpiece.

For mailpieces of low thickness, the bag is deformed to a small extent only, and the balls are moved to a small extent only, whereas they are moved to a larger extent for mailpieces of higher thickness. The mailpieces of high thickness are retained very effectively due to the high quantity of energy necessary for moving the balls. This energy requires time in order to be transferred from the drive member to the bag, thereby facilitating separation. Conversely, mailpieces of low thickness require less energy, but separation takes place over a longer distance. The retaining force increases with increasing length of the path due to the numerous points of contact with the balls so that said mailpieces of low thickness are as well separated as the others.

With the present invention, a separator device is proposed that is simple, compact, and inexpensive because it has only very few components and, above all, requires no adjustment, unlike prior art devices that have guides. In addition, it can be implemented with various drive member configurations, comprising rollers or belts, and the make-up of the flexible bag that can have one or more compartments disposed between or on said drive members is very flexible, i.e. said bag can be implemented in a variety of manners.

It can be observed that, although the invention that is described above in its preferred application to a mailpiece feeder, the present invention is also applicable to separating any other flat article, i.e. to separating articles other than mailpieces.

What is claimed is:

1. A separator device for separating flat articles one-by-one from a stack of flat articles and for conveying them downstream, wherein said separator device comprises a plurality of balls disposed inside at least one flexible bag and co-operating with a drive member so that, by deforming while said flat articles are being conveyed downstream, it separates said flat articles one-by-one.

2. A separator device according to claim 1, wherein said flexible bag is in the shape of a block of trapezium-shaped section.

3. A separator device according to claim 1, wherein said flexible bag has a plurality of compartments.

4. A separator device according to claim 1, wherein said flexible bag is made of a technical textile material such as nylon.

5. A separator device according to claim 1, wherein said balls have a diameter of less than 10 mm.

6. A separator device according to claim 5, wherein said balls are made of a material chosen from the following materials: metal; glass, and elastomer.

7. A separator device according to claim 1, wherein said drive member comprises at least one series of motor-driven rollers.

8. A separator device according to claim 1, wherein said drive member comprises at least one motor-driven belt.

9. A separator device according to claim 1, wherein said flat articles are mailpieces.

10. A mailpiece feeder for a franking machine, which feeder includes a mailpiece separator device according to claim 9.

* * * * *